US007070074B2

(12) United States Patent
Landsberger et al.

(10) Patent No.: US 7,070,074 B2
(45) Date of Patent: Jul. 4, 2006

(54) HOSIERY DONNING AID

(75) Inventors: Kurt Landsberger, Verona, NJ (US); Paul Thom, Clifton, NJ (US); David Landsberger, Caldwell, NJ (US); Francis Gomes, Jersey City, NJ (US)

(73) Assignee: Bel-Art Products, Inc., Pequannock, NJ (US)

( * ) Notice: Subject to any disclaimer, the term of this patent is extended or adjusted under 35 U.S.C. 154(b) by 0 days.

(21) Appl. No.: 10/354,007

(22) Filed: Jan. 30, 2003

(65) Prior Publication Data

US 2004/0149789 A1 Aug. 5, 2004

(51) Int. Cl.
*A47G 25/80* (2006.01)

(52) U.S. Cl. ..... 223/113; 223/111

(58) Field of Classification Search ..... 223/113, 223/112, 111; D2/641
See application file for complete search history.

(56) References Cited

U.S. PATENT DOCUMENTS

| | | | | |
|---|---|---|---|---|
| 2,982,453 | A | | 2/1961 | Zicarelli |
| 3,231,160 | A | | 1/1966 | Glanville |
| 4,066,194 | A | | 1/1978 | Leland |
| D259,300 | S | | 5/1981 | Vreeken |
| 4,284,216 | A | | 8/1981 | Leland |
| 4,497,424 | A | | 2/1985 | Smith |
| 4,637,532 | A | | 1/1987 | Doorenbos |
| 4,651,909 | A | | 3/1987 | Banting |
| 4,765,520 | A | | 8/1988 | Barton |
| 4,896,803 | A | | 1/1990 | Wilkens |
| 4,942,988 | A | | 7/1990 | Doorenbos |
| 4,991,757 | A | | 2/1991 | Deakyne |
| 5,050,783 | A | | 9/1991 | Hunter |
| 5,082,154 | A | | 1/1992 | French |
| D337,881 | S | * | 8/1993 | Peeler ..... D2/641 |
| 5,303,856 | A | | 4/1994 | Weatherholt, Sr. |
| D365,913 | S | | 1/1996 | Ballard |
| 5,513,783 | A | | 5/1996 | White |
| D372,113 | S | | 7/1996 | Palmer et al. |
| 5,566,868 | A | | 10/1996 | Mariscal et al. |
| 5,593,071 | A | | 1/1997 | Lusk |
| 5,630,534 | A | * | 5/1997 | Maier et al. ..... 223/112 |
| 5,632,424 | A | | 5/1997 | Maier et al. |
| 5,769,289 | A | | 6/1998 | Lusk |
| 5,799,844 | A | | 9/1998 | James |
| 5,826,761 | A | * | 10/1998 | Basaj ..... 223/112 |
| 5,894,970 | A | | 4/1999 | Belkin et al. |
| 5,909,831 | A | | 6/1999 | Griffin |
| 5,924,610 | A | | 7/1999 | Willemin |
| 5,927,573 | A | * | 7/1999 | Votino et al. ..... 223/111 |
| D414,313 | S | | 9/1999 | Maier et al. |
| 5,974,701 | A | | 11/1999 | Busch |

(Continued)

FOREIGN PATENT DOCUMENTS

| | | |
|---|---|---|
| DE | 19720573 | 11/1998 |

(Continued)

OTHER PUBLICATIONS

Maddak, Inc., catalog No. 0699, pp. 33-35.

*Primary Examiner*—Gary L. Welch
(74) *Attorney, Agent, or Firm*—Lawrence G. Fridman

(57) ABSTRACT

A hosiery donning aid consists of a base, at least one hosiery support and at least one handle support. The hosiery support has a support element carried by the base. The handle support has a handle outwardly extending from the base in adjacent relationship to the hosiery support.

25 Claims, 13 Drawing Sheets

U.S. PATENT DOCUMENTS

| | | | |
|---|---|---|---|
| 6,032,839 | A | 3/2000 | Joosten et al. |
| 6,056,171 | A | 5/2000 | Santamaria |
| 6,102,262 | A | 8/2000 | Nicholson |
| 6,234,369 | B1 | 5/2001 | Bort |
| 6,276,578 | B1 | 8/2001 | Stenger |

FOREIGN PATENT DOCUMENTS

| | | |
|---|---|---|
| FR | 2785783 | 5/2000 |
| GB | 2221604 | 2/1990 |

* cited by examiner

HOSIERY DONNING AID

FIELD OF THE INVENTION

The present invention relates generally to hosiery donning aid, and more particularly, it relates to devices for assisting in the donning stockings, panty hose, etc.

DESCRIPTION OF THE PRIOR ART

Elastic hosiery including stockings and pantyhose has been popular among women of all ages for many years. Some such hosiery is worn for comfort and aesthetic purposes, while other types of elastic hosiery have medical applications, such as compression stockings prescribed for elderly persons in the treatment of varicose vein conditions or other circulatory disorders. Due to the highly elastic nature of these stockings, persons afflicted with arthritis, obesity and other infirm conditions often lack the considerable hand and arm strength required to pull the hosiery up over the legs. In addition, some persons lack the flexibility to bend their legs or bodies sufficiently to apply hosiery. Accordingly, various devices have been developed for assisting persons in the donning of socks, stockings, pantyhose or other hosiery.

The hosiery-donning assist devices of the prior art generally suffer from one or more drawbacks and limitations that oftentimes render them undesirable or unsuitable for use. Generally, these drawbacks and limitations stem from the device structure. By way of example, U.S. Pat. No. 4,896,803 to Wilkens discloses hosiery-donning aids incorporating a relatively complex framework structure. In particular, the Wikens patent discloses an aid for putting on compression stockings comprising a frame-like construction including multiple parallel-extending L-shaped support rods each having first ends interconnected by a first semicircular rod-like clip and second ends interconnected by a second U-shaped rod-like clip. In spite of the complex frame-like construction the Wilkens aid is not formed with independent handles facilitating use of the device. It is obvious that manufacturing of such a device is laborious and expensive. In use, the device is initially placed against a supporting surface and a single compression stocking rolled outwards over the structure. Subsequently, the user's foot is inserted into the foot part of the stocking and then the device is gripped laterally with the hands, while simultaneously gripping the stockings through the spacing between vertical portions of the support rods to enable rolling of the stockings up the leg. Accordingly, in view of the absence of independent handles and other factors discussed hereinabove, the disclosed device requires substantial user hand and finger dexterity in order to simultaneously grip the lateral user support portions and the stockings themselves. For arthritis sufferers and those otherwise having limited hand and finger dexterity, the disclosed device should be difficult, if not impossible, to employ. Furthermore, the framework structure of the disclosed device is generally unstable and not useful for frail or unsteady persons requiring an auxiliary supporting structure to grasp onto to maintain balance while putting on hosiery. An additional limitation of the disclosed device is that it does not provide a solid guiding and support surface against which the user's foot can slide while donning the hosiery, increasing the tendency for hosiery tearing or ripping. An even more sophisticated sock donning assist device disclosed by U.S. Pat. No. 5,630,534 to Maier, which is formed with independent handles also reflects some of the prior art drawbacks discussed hereinabove.

U.S. Pat. No. 4,497,424 to Smith discloses another elastic hosiery applicator having a frame-like structure. Specifically, the Smith patent discloses a hosiery applicator having a circular wire frame and multiple retainer flanges extending downwardly from the wire frame for supporting the mouth of the hosiery. In application, the user inserts a foot through the wire frame and then pulls the frame upwardly over the leg in such a manner that the hosiery is pulled, behind the frame, up and over the leg. Accordingly, the device disclosed in the Smith patent is specifically designed for assisting in the donning of stockings or single-legged hosiery. The design characteristics of the device do not permit use of the device to apply pantyhose or other double-legged hosiery. Furthermore, in addition to a relatively unstable structure, the device does not provide a handle or other support for the user to stabilize herself while placing a leg through the wire frame and into the hosiery.

The devices disclosed in U.S. Pat. Nos. 4,066,194; 4,284,216; 5,632,424 and 5,769,289 are useful for aiding a person in the donning of socks, but are not always suited for the application of longer hosiery such as stockings or pantyhose. U.S. Pat. Nos. 4,630,534; 4,765,520 and 4,942,988 disclose other types hosiery-donning devices that suffer from one or more of the aforementioned drawbacks and limitations of the prior art. Many of the above-mentioned devices are heavy and typically offered in pre-assembled conditions, which makes them quite bulky. As a result, their manipulation, shipment and storage can be cumbersome and expensive.

Accordingly, there is a well-established need for a hosiery donning aid that avoids the drawbacks and limitations of the prior art. In particular, it would be desirable to provide a hosiery donning aid which is relatively simple in construction, free-standing and stable, usable by handicapped persons, capable of providing superior support to the hosiery as it is being pulled on, and includes a guiding and support surface for the user's leg in general and the heel in particular, so as to facilitate insertion of the leg into the stocking. Furthermore, it would be desirable to provide such a hosiery donning aid that can be employed during the donning of hosiery of all types, including double-legged hosiery such as pantyhose, onto the legs of a user. Furthermore, it would be desirable to provide a sock hosiery donning aid capable of being shipped and easily assembled by an ultimate user in a relatively simple, quick and efficient manner without special skills or special tools.

SUMMARY OF THE INVENTION

The invention is directed to a hosiery donning aid for facilitating the donning of stockings, pantyhose or other hosiery, and is particularly adapted for use by handicapped, frail and otherwise unsteady persons. The aid incorporates a free standing, simple, and stable design which facilitates the donning of stockings or other single-legged hosiery in one embodiment, as well as the donning of pantyhose or other double-legged hosiery in another embodiment. The structure of the donning aid may be gripped during use to steady the user during application of the hosiery.

In one general aspect of the present invention, a hosiery-donning aid is provided having a base, at least one hosiery support having a support element extending upward from the base for supporting the hosiery in an open, leg-receiving configuration, and at least one handle support having a handle upwardly-standing from the base for gripping by the user as the hosiery is applied.

In another aspect of the present invention, the support element incorporates a solid U-shaped configuration having an elongated depression formed therein for providing sliding support to the user's foot during donning of the hosiery.

In a further aspect of the present invention, finger slots may be provided in the handle for gripping by the user.

In still another aspect of the present invention, the base, hosiery support and at least one handle support are of unitary construction.

In yet another aspect of the present invention, the base, at least one hosiery support and at least one handle support are separate elements configured for being assembled to define the hosiery donning aid.

In yet a further aspect of the present invention, the hosiery-donning aid may be used to aid in the donning of stockings or other single-legged hosiery.

Still another aspect of the present invention provides a hosiery donning aid that may be used to aid in the donning of pantyhose or other double-legged hosiery.

In yet a further aspect of the present invention, a hosiery donning aid is provided which is characterized by a relatively simple construction and which is stable, capable of use by handicapped or other unsteady persons, and facilitates ease in sliding a user's leg into the hosiery to prevent or minimize excessive stretching and the possibility of tearing the hosiery.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the figures, the present invention is generally directed to a device for aiding persons in the donning of hosiery, and is particularly suited for use by persons having limited body flexibility, range of motion and/or dexterity. The apparatus incorporates a free standing and sturdy design which is relatively simple in construction, easy to use and facilitates the donning of stockings, pantyhose or other hosiery to the legs of a user without the application of undue stress to the hosiery.

Figure 1:
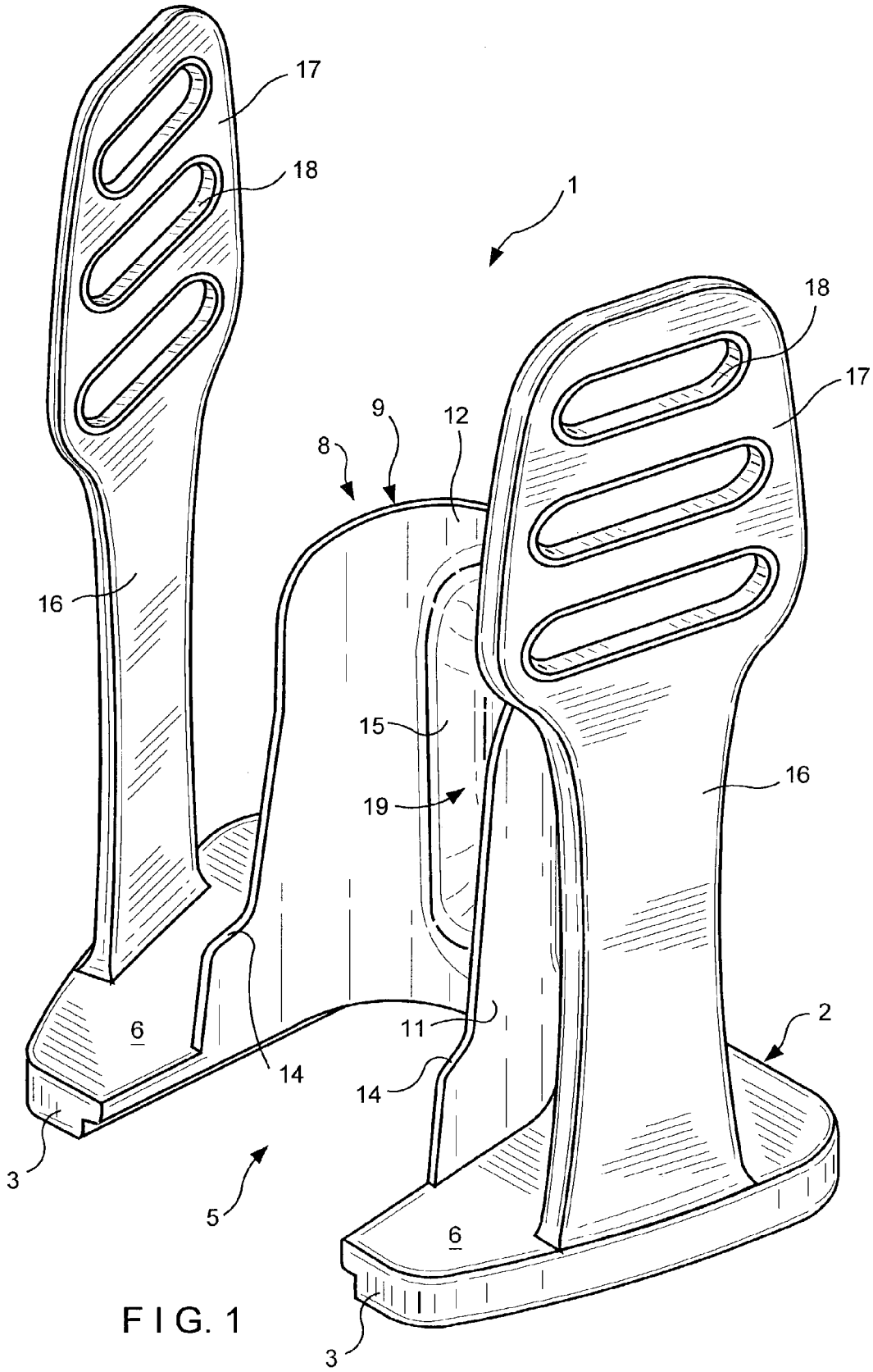
FIG. 1 is a front perspective view of a unitary construction embodiment of the hosiery donning aid of the present invention.
Figure 3:
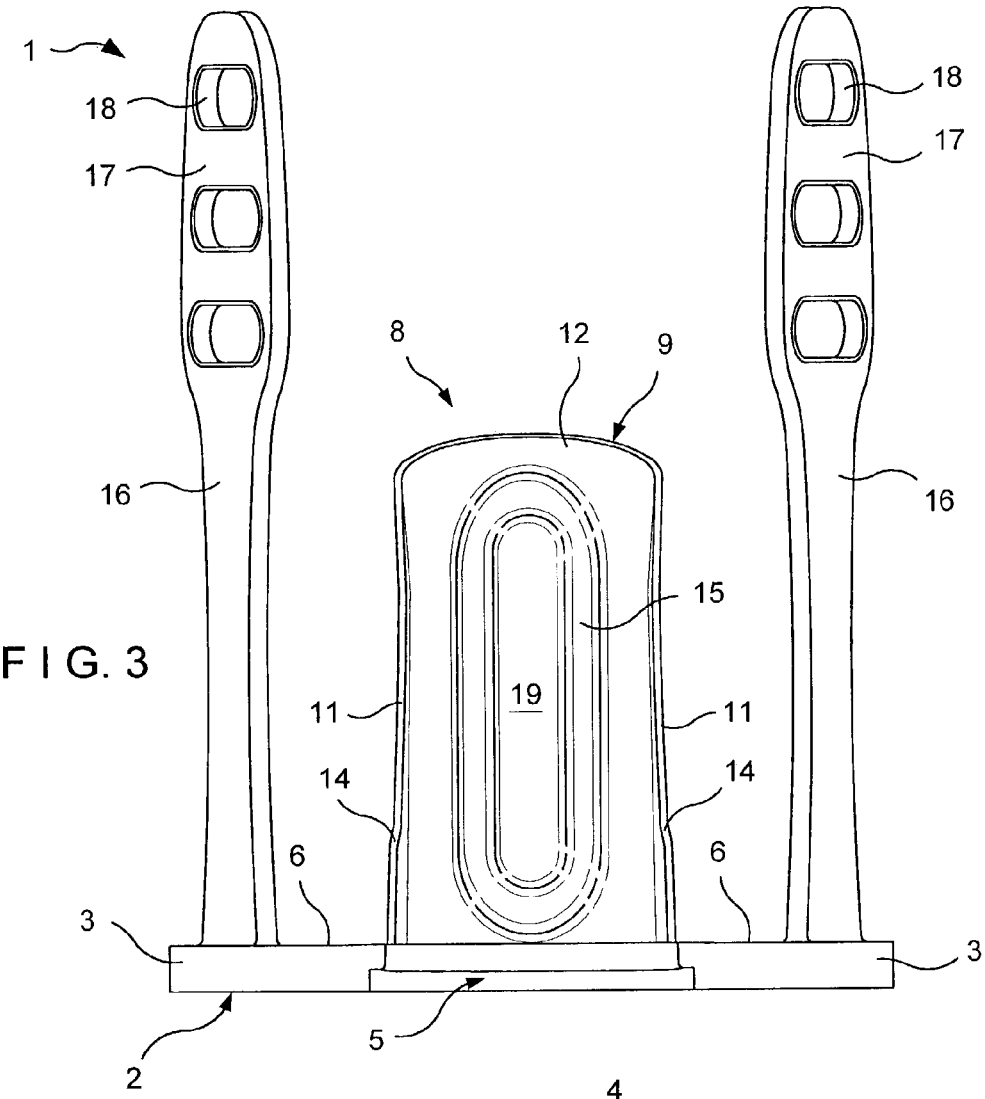
FIG. 3 is a front elevational view of the hosiery donning aid of FIG. 1.
Figure 4:
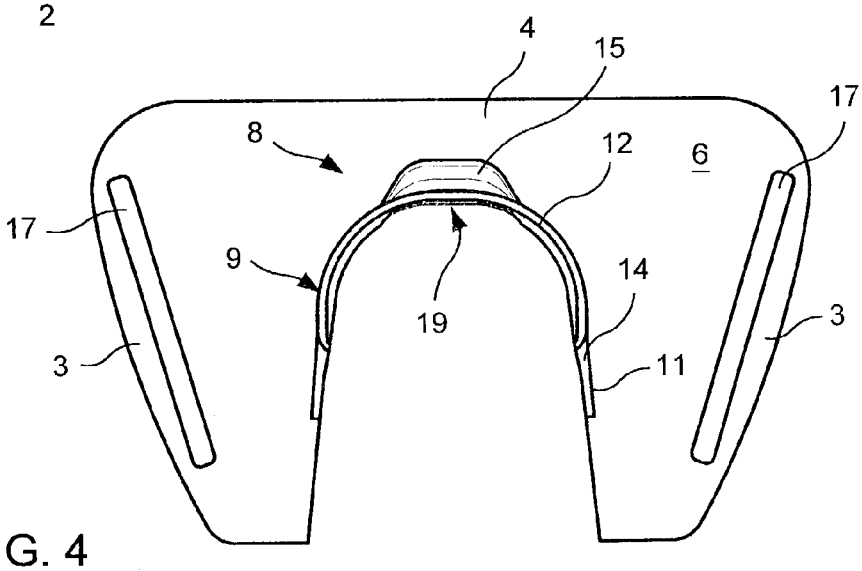
FIG. 4 is a top plan view of the hosiery donning aid of FIG. 1.

Referring initially to FIGS. 1, 3 and 4, a unitary construction embodiment of the hosiery donning aid 1 of the present invention includes a generally C-shaped base 2, having a top surface 6 and a pair of spaced-apart side base portions 3 which are connected by a transverse rear base portion 4 (FIG. 4). A generally U-shaped foot space 5 separates the side base portions 3 from each other. A hosiery support 8 includes a substantially solid support element 9 extending outwardly from the top surface 6 of the base 2. As best depicted in FIG. 4, the support element 9 has a generally U-shaped configuration when viewed from above and includes a pair of side panel portions 11 which are continuous with a curved or arcuate rear portion 12. The side panel portions 11 are spaced from the respective side base portions 3, on opposite sides of the foot space 5, whereas the rear portion 12 is separated from the rear base portion 4, and is disposed along the rear curvature of the foot space 5. A substantially vertically oriented, elongated, generally elliptical protrusion 15 preferably extends rearwardly from the rear portion 12 of the support element 9 to define a support formation or heel-guiding depression 19. As shown in FIG. 1, for example, a gently sloping panel shoulder 14 is typically provided along a front edge of each side panel portion 11, proximate to its junction with the base 2. A pair of slightly inwardly turned handle supports 16 extend outwardly from the top surface 6 of the respective side base portions 3, on respective sides of and in spaced-apart relationship to the hosiery support 8. The upper end of each handle support 16 includes a planar enlargement that defines a handle panel 17, through which typically extend one or more finger receiving slots 18.

Figures 2A, 2B:
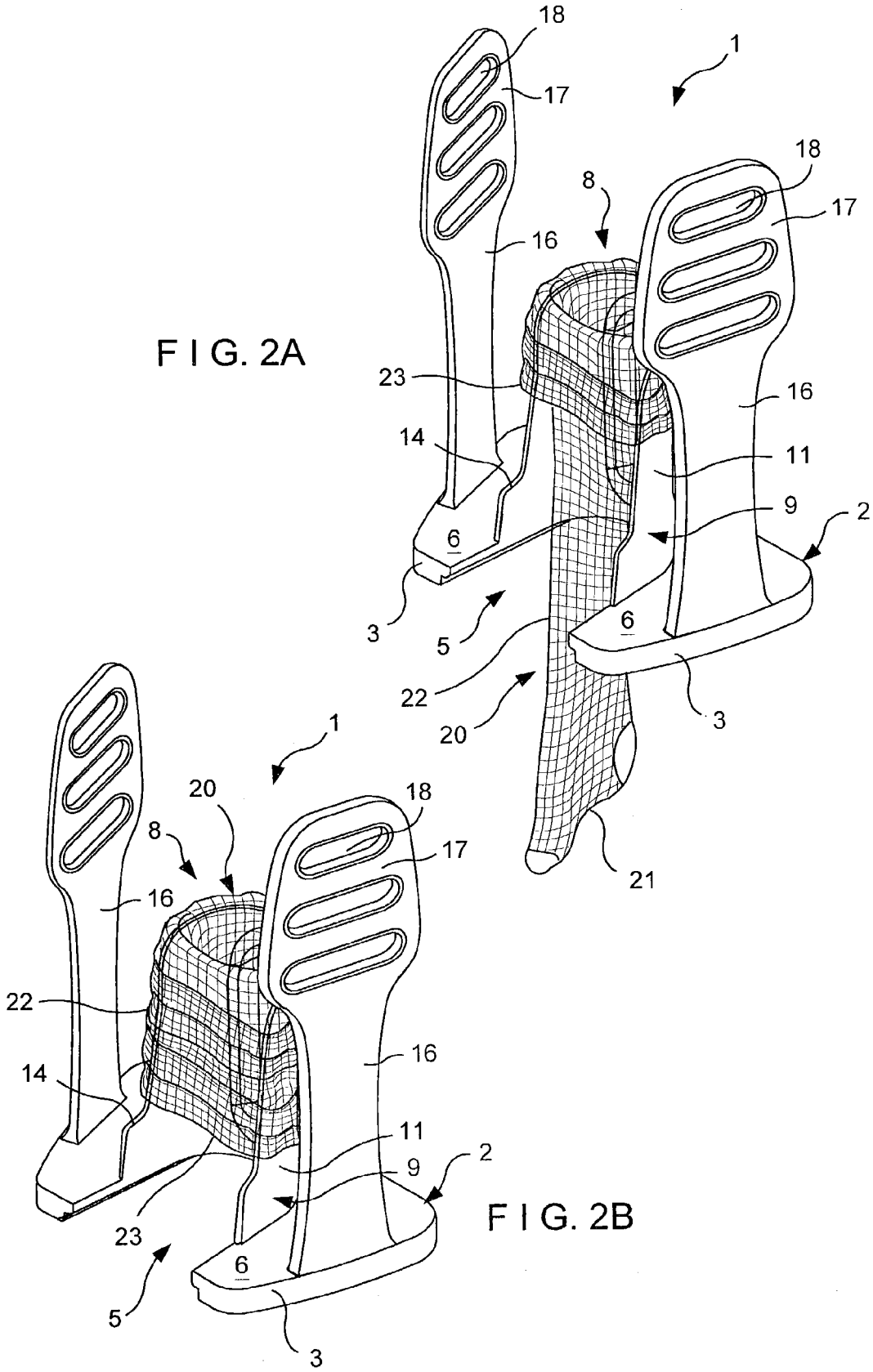
FIG. 2A is a front perspective view of the hosiery donning aid of FIG. 1, with a stocking partially nested in the hosiery support element of the device, during an initial step in typical application of the invention.
FIG. 2B is a front perspective view of the hosiery donning aid of FIG. 1, with a stocking nested in the hosiery support element of the device, during another step in typical application of the invention.
Figure 2C:
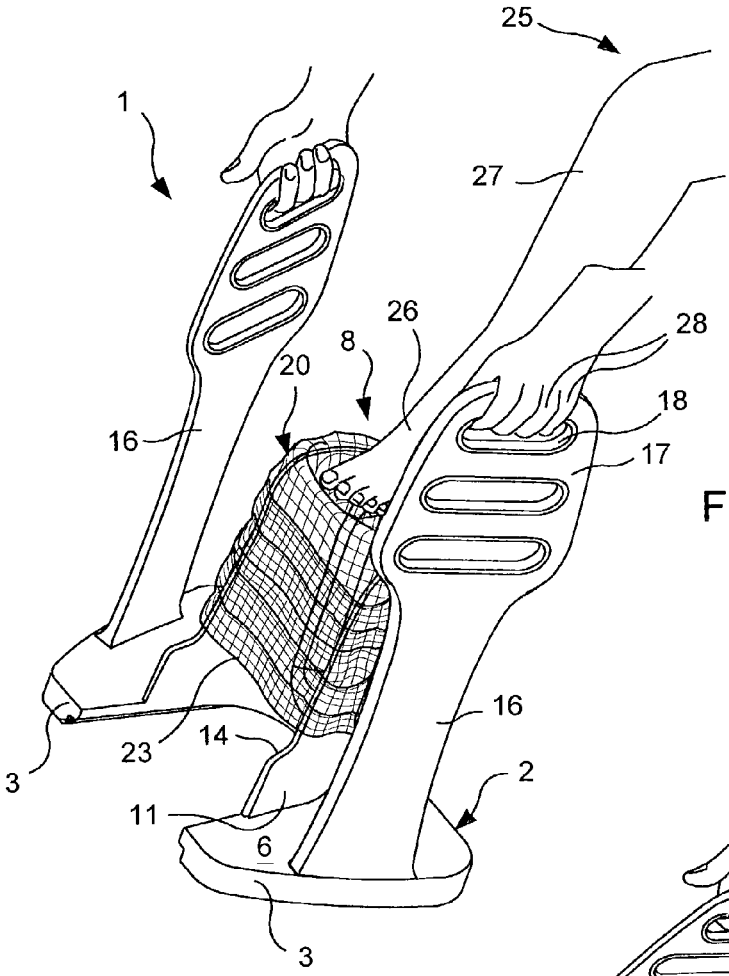
FIG. 2C is a front perspective view of the hosiery donning aid of FIG. 1, illustrating insertion of a user's foot/leg into the nested stocking, as a further step in typical application of the invention.
Figure 2D:
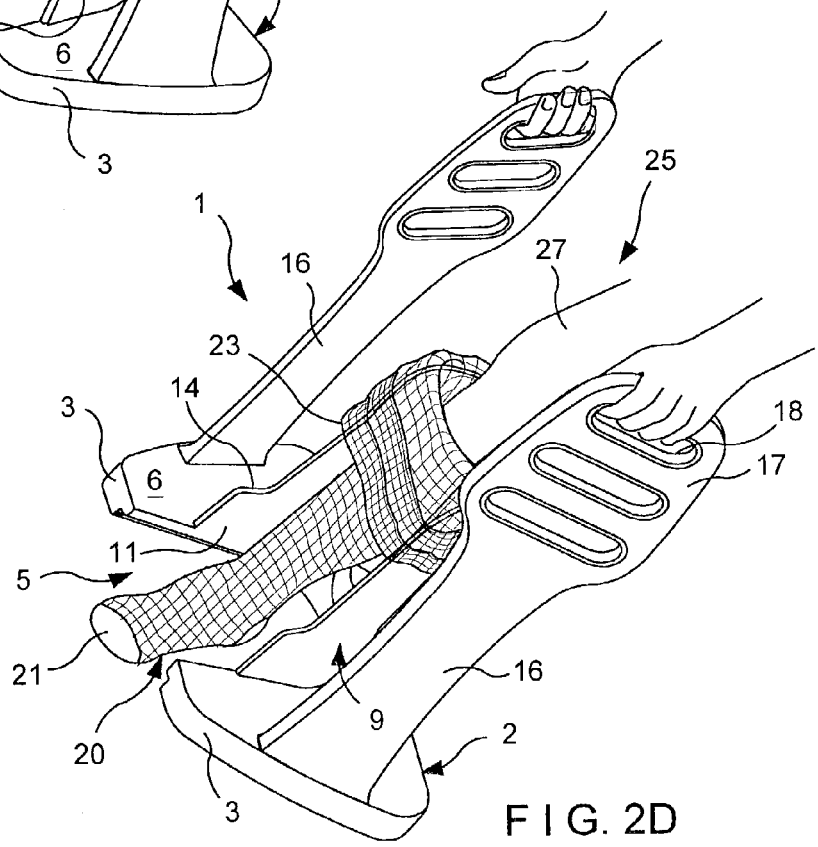
FIG. 2D is a front perspective view of the hosiery donning aid of FIG. 1, illustrating insertion of the user's foot/leg into the stocking or raising of the device by the user to apply the stocking to the user's leg in still another step in typical application of the invention.

Referring now to FIGS. 2A–2D, in typical application the unitary hosiery donning aid 1 of the present invention is used to assist in the donning of a stocking 20 or other single-leg hosiery on the leg 27 of a user 25. Accordingly, as shown in FIG. 2A, the leg portion 22 of the stocking 20 is initially extended through the support element 9 and the foot space 5. In this condition the upper edge 23 of the stocking 20 is turned down and nested over the upper edge of the support element 9. Next, as shown in FIG. 2B, the downwardly-folded or nested leg portion 22 of the stocking 20 is pulled downwardly over the exterior of the support element 9 until the upper edge 23 of the stocking 20 is positioned near or engages the shoulder 14 and the foot portion 21 of the stocking 20 is drawn upwardly into the confines of the support element 9. As shown in FIG. 2C, while grasping the handle slots 18 using fingers 28, the user 25 then inserts her or his foot 26 into the open mouth of the stocking 20, which is held open by the support element 9, until the user's foot 26 is inserted into the foot portion 21 of the stocking 20. Finally, as shown in FIG. 2D, the user 25 continues to extend her or his leg into the stocking 20 until the foot portion 21 of the stocking 20 descends to the foot space 5 between the side base portions 3. Simultaneously, the leg portion 22 of the stocking 20, which is initially wrapped around the exterior of the support element 9, progressively slides upwardly on the support panel 9 and recoils around the leg 27 of the user 25. That upper portion of the stocking 20 which remains wrapped around the support element 9 may then be manually removed from the support element 9 to recoil around the leg 27 of the user 25, after which the user's leg 27 with the stocking 20 is removed from the donning aid 1. The same procedure is then repeated to don the other stocking 20 on the user's other leg 27. As illustrated in FIGS. 2C and 2D, donning of the stocking 20 can be facilitated by slight tilting of the aid 1 toward the user 25 during insertion of the foot 26 into the stocking 20. A heel of the user's foot can be supported by the front surface of the support element 9. However, significantly, in the preferred embodiment, while donning the stocking, the heel of the user's foot 26 is received and guided within rear panel of the heel guiding depression or support formation 19 and supported against the interior surface of rear panel protrusion 15. By providing the guiding depression and supporting surface, less strain is placed on the user's leg, back and upper body. Additionally, use of the guiding and supporting surface in the donning of hosiery minimizes the occurrence of stocking ripping or tearing by enabling controlled foot insertion against a smooth surface.

Figure 5:
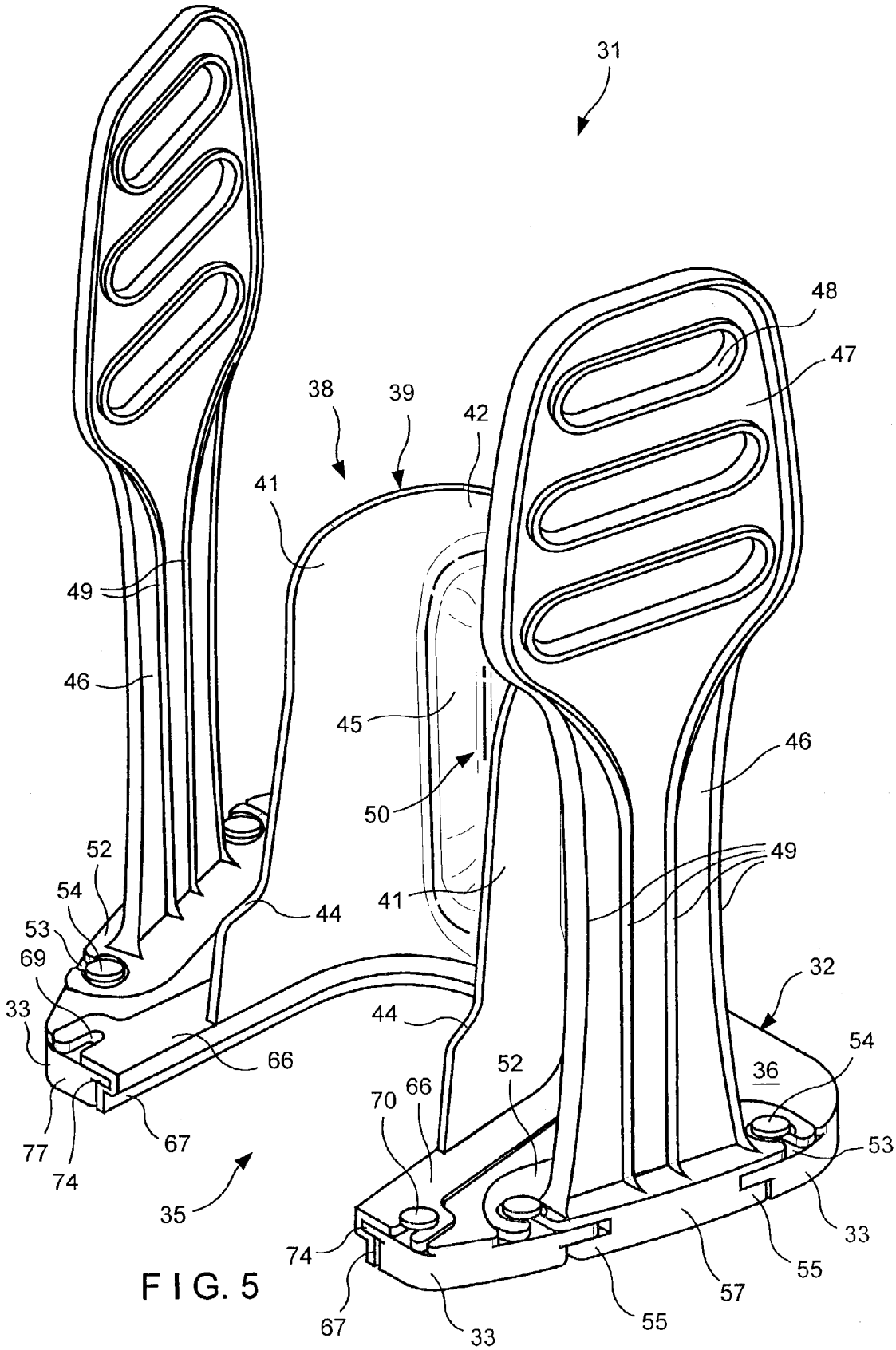
FIG. 5 is a front perspective view of an assembled multi-component embodiment of the hosiery donning aid of the present invention.
Figure 6:
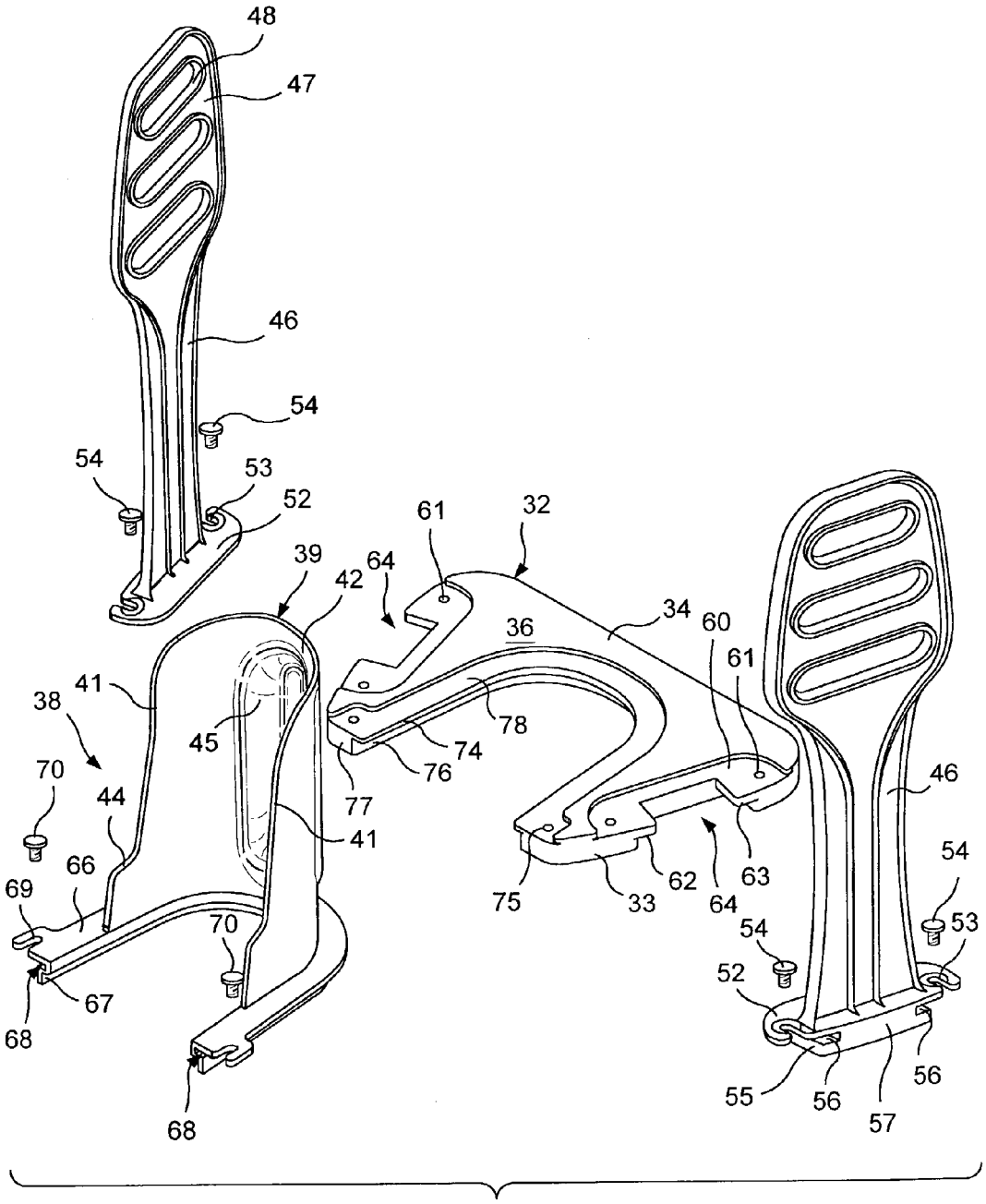
FIG. 6 is an exploded, perspective view of the disassembled multi-component embodiment of the hosiery donning aid of FIG. 5.
Figure 7:
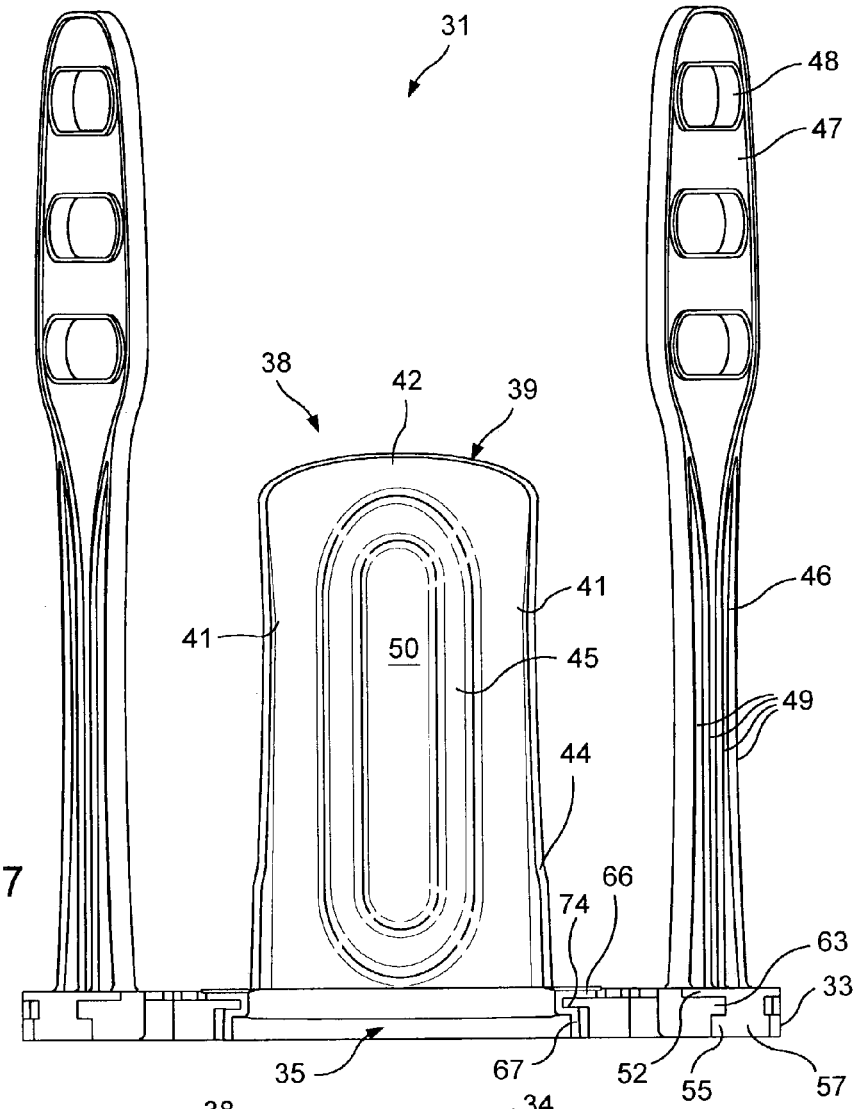
FIG. 7 is a front elevational view of the multi-component hosiery donning aid.
Figure 8:
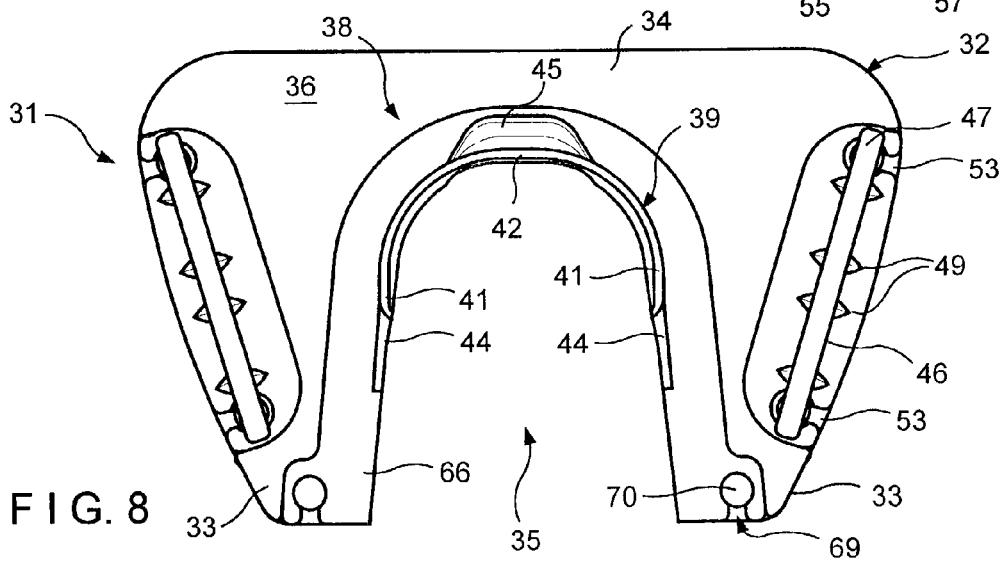
FIG. 8 is a top plan view of the multi-component hosiery donning aid.
Figure 10:
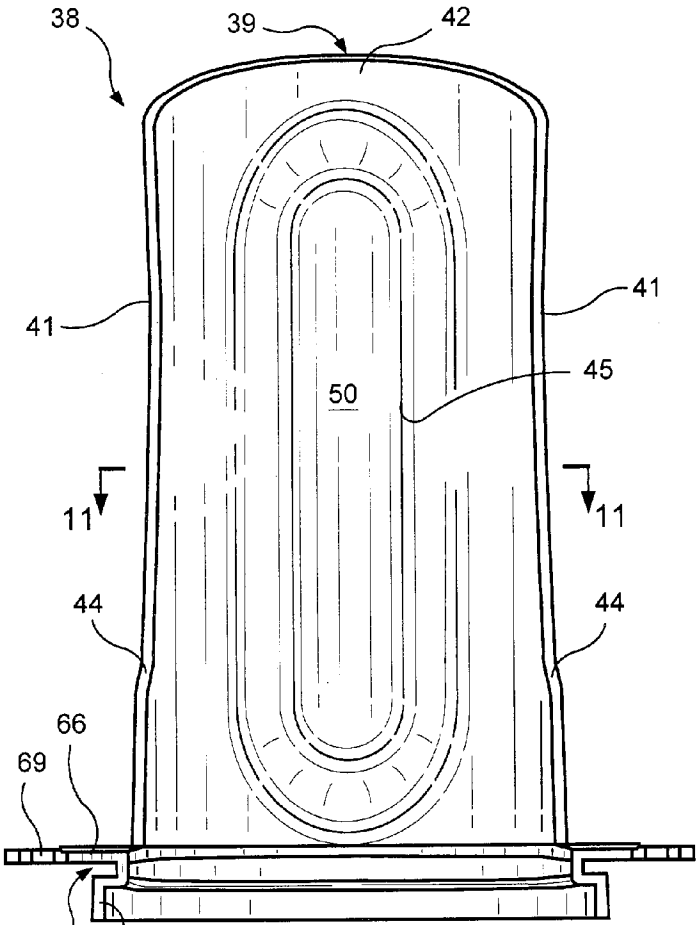
FIG. 10 is a front elevational view of the hosiery support element of FIG. 9.
Figure 12:
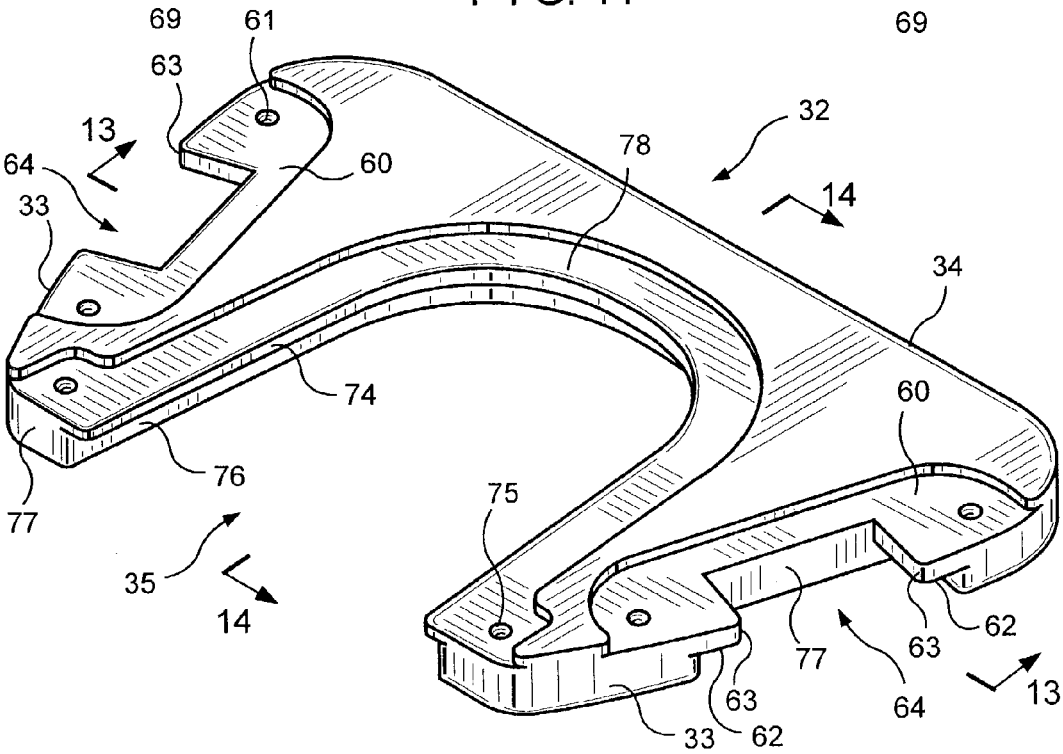
FIG. 12 is a front perspective view of the base element of the multi-component hosiery donning aid of FIG. 5.
Figure 13:
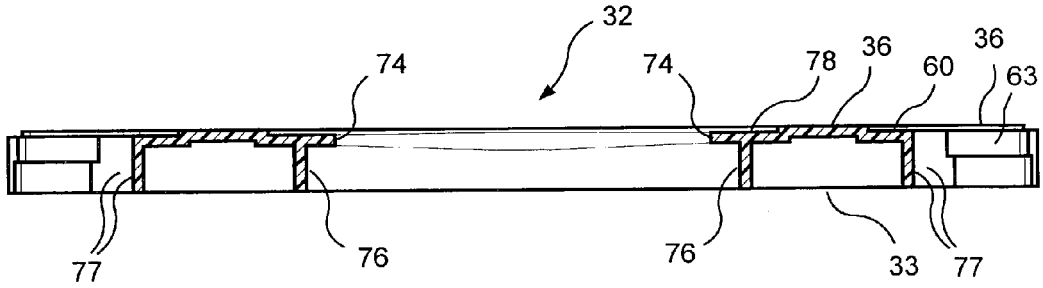
FIG. 13 is a cross-sectional view taken along cutting plane 13—13 of FIG. 12.
Figure 14:
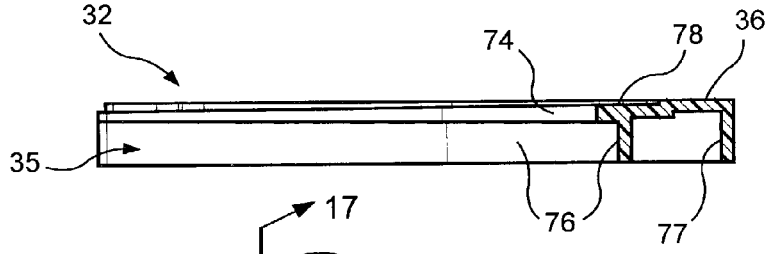
FIG. 14 is a cross-sectional view taken along cutting plane 14—14 of FIG. 12.
Figure 15:
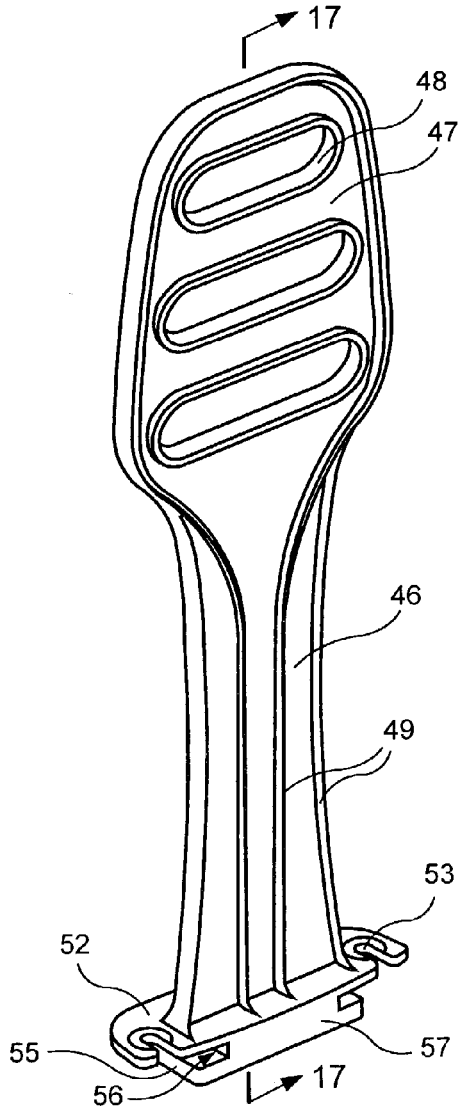
FIG. 15 is a front perspective view of a handle support and handle element of the multi-component hosiery donning aid of FIG. 5.
Figure 16:
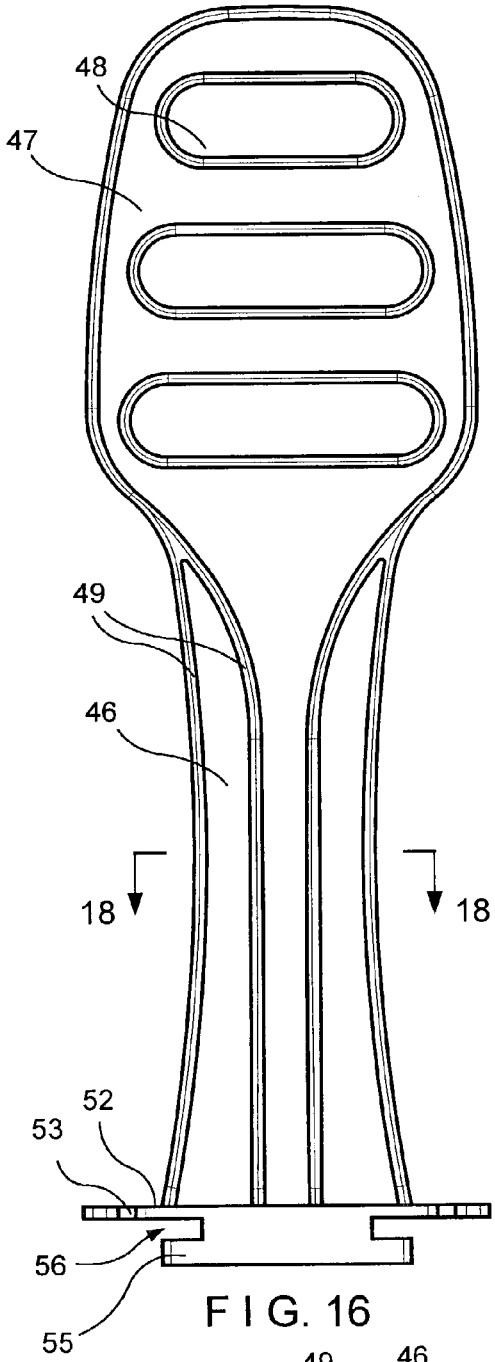
FIG. 16 is a front elevational view of the handle support and handle element.
Figure 17:
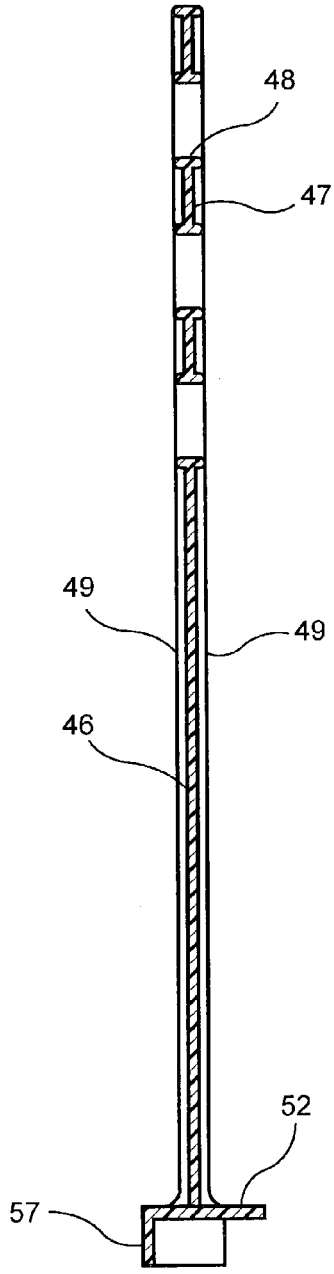
FIG. 17 is a longitudinal sectional view of the handle support and handle element taken along cutting plane 17—17 of FIG. 15.
Figure 18:
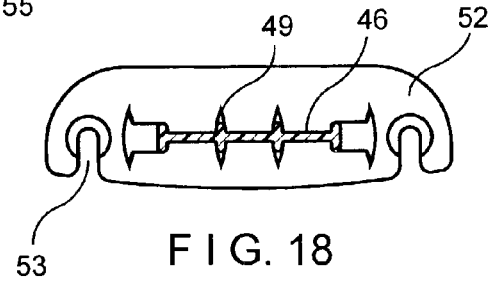
FIG. 18 is a cross-sectional view taken along cutting plane 18—18 of FIG. 16.

Referring next to FIGS. 5–8, illustrating another embodiment of the present invention, the various features of which will be hereinafter described. A multi-component hosiery donning aid 31 includes a generally C-shaped base 32, having top surface 36 and a pair of spaced-apart side base portions 33 which are connected by a transverse rear base portion 34 (see, for example, FIGS. 6, 8 and 12) and separated from each other by a generally U-shaped foot space 35, as best shown in at least FIGS. 5–8. As best illustrated in FIGS. 12–14, the base 32 includes an outer base wall 77 that extends along its outer perimeter and an inner base wall 76 that is spaced from the outer base wall 77 and defines the boundary or walls of the foot space 35. As shown in FIGS. 6 and 12, a top flange depression 60 is provided in the top surface 36 of each side base portion 33. A bottom flange depression 62 is separated from the top flange depression 60 by a pair of depression flanges 63, which are separated from each other by a flange gap 64. A pair of fastener receiving or screw openings 61 may be provided, so as to extend downwardly through the side base portions 33 in the top flange depression 60, on respective sides of the flange gap 64. A continuous, generally U-shaped base flange 74 is spaced from and extends substantially parallel to the top surface 36. The base flange 74 actually extends from the side base portions 33 and the rear base portion 34, into the foot space 35, and defines a U-shaped flange recess 78. A fastener or screw opening 75 may be formed, so as to extend into the side base portions 33 of the flange recess 78, on each side of the foot space 35.

Figure 9:
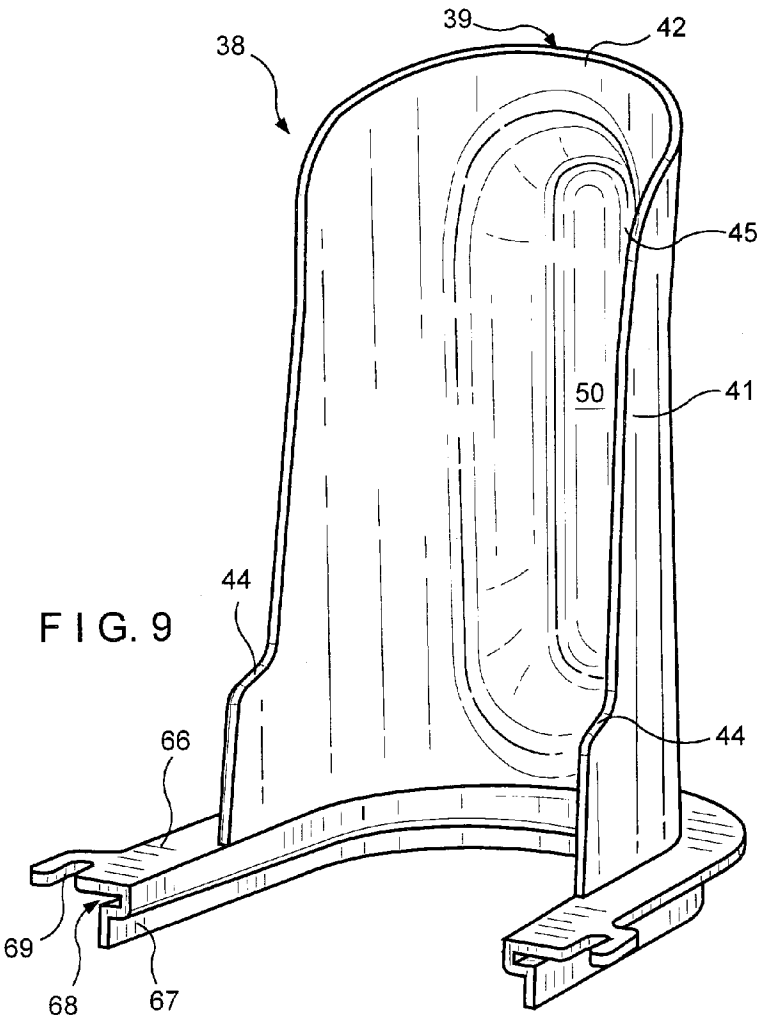
FIG. 9 is a front perspective view of a hosiery support element of the multi-component hosiery donning aid.
Figure 11:
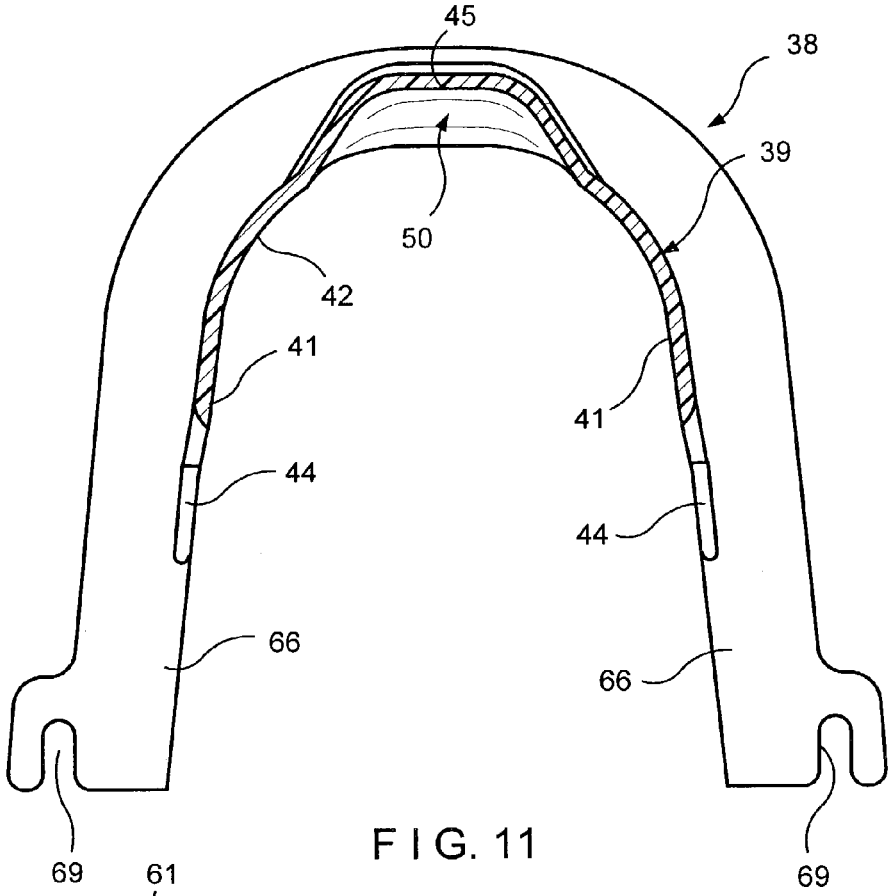
FIG. 11 is a cross-sectional view taken along cutting plane 11—11 of FIG. 10.

Referring particularly to FIGS. 5–11, a hosiery support 38 includes a support element 39 extending outwardly from a U-shaped substantially flat bottom flange 66. An engaging bottom flange 67, which is coextensive with the flat bottom flange 66, extends downwardly from the flat bottom flange 66 and includes a horizontal offset that defines a flange slot 68. A fastener slot 69 terminates each end of the flat bottom flange 66. The substantially U-shaped support element 39 includes a pair of side panel portions 41 which are continuous with a curved or arcuate rear portion 42. An elongated, longitudinally extending protrusion 45 preferably extends rearwardly from the rear curved portion 42 of the support 39 to define a heel-guiding and receiving depression 50. As clearly illustrated in at least FIGS. 9 and 10, the engagement area between the curved portion 42 and the protrusion 45 is defined by a straight lined central section which is interposed between two curved sections provided at both ends thereof. In the preferred embodiment of the invention, the protrusion 45 is substantially centrally located within the curved portion 42. However, any other suitable configuration and location of the protrusion are within the scope of the invention. As best illustrated in FIGS. 5 and 9, a gently sloping shoulder 44 is typically provided along a front edge of each side panel portion 41, proximate to the flat bottom flange 66. The hosiery support 38 can be used as a part of the hosiery donning assembly or it can be used independently. During the independent use of the hosiery support 38, the stocking is initially positioned on the support element 39 in a manner similar to that described with reference to FIGS. 2A and 2B. The donning aid 38 can be provided with a pulling strap (not shown) having ends thereof attached to the exterior of the support element 39 in the vicinity of shoulders 44. In use, while grasping the strap the user inserts her foot into the open mouth of the stocking in a manner similar to that illustrated in FIG. 2C. Then, the user continues to extend her leg into the stocking until it is fully positioned within the foot portion thereof (in a manner shown in FIG. 2D).

Referring now particularly to FIGS. 5–8 and 15–18, the bottom end of each of a pair of handle supports 46 is provided with a handle support top flange 52 having a pair of spaced-apart fastener or screw openings 53. A handle support bottom flange 55 is connected to the handle support top flange 52 by a flange-connecting portion 57. A flange slot 56 is defined between the handle support top flange 52 and the handle support bottom flange 55. The upper end of each handle support 46 includes a planar enlargement that defines a handle panel 47, through which typically extends one or more finger slots 48. Stiffening ribs or flanges 49 may longitudinally extend through each of the handle supports 46 so as to enhance its bending and shearing resistance.

Referring now particularly to FIGS. 5–8, the multi-component hosiery donning aid 31 is assembled as follows. The hosiery support 38 is attached to the base 32 by initially inserting the substantially flat bottom flange 66 in the companion flange recess 78 of the base 32 and the base flange 74 of the base 32 in the companion flange slot 68 of the hosiery support 38, with the fastener slots 69 in the flat bottom flange 66 registering with the respective fastener openings 75 in the base flange 74. Then, fasteners or screws 70 are extended through each slot 69, so as to engage the underlying registering fastener or screw opening 75 to removably secure the hosiery support 38 to the base 32.

Each handle support 46 is mounted on the base 32 by initially seating the handle support top flange 52 in the corresponding top flange depression 60 of the base 32 as the depression flanges 63 of the base 32 are inserted in the respective flange slots 56 of the handle support 46. Accordingly, the fastener or screw slots 53 in the handle support top flange 52 are disposed in registering relationship with the respective underlying fastener or screw openings 61. Finally, a fastener or screw 54 is extended through each slot 53, so as to engage the corresponding underlying opening 61 to secure the upward-standing handle supports 46 onto the base 32. The hosiery donning aid of this embodiment can be assembled at a site in relatively simple, quick and efficient manner without special skills or tools. This approach substantially simplifies shipment, storage and assembly of the hosiery-donning aid devices. When in the assembled configuration shown in FIGS. 5, 7 and 8, the multi-unit hosiery donning aid 31 may be used to don a stocking or other single-legged hosiery (not shown) on the legs of a user, in the same manner as heretofore described with respect to FIGS. 2A–2D.

Figure 19:
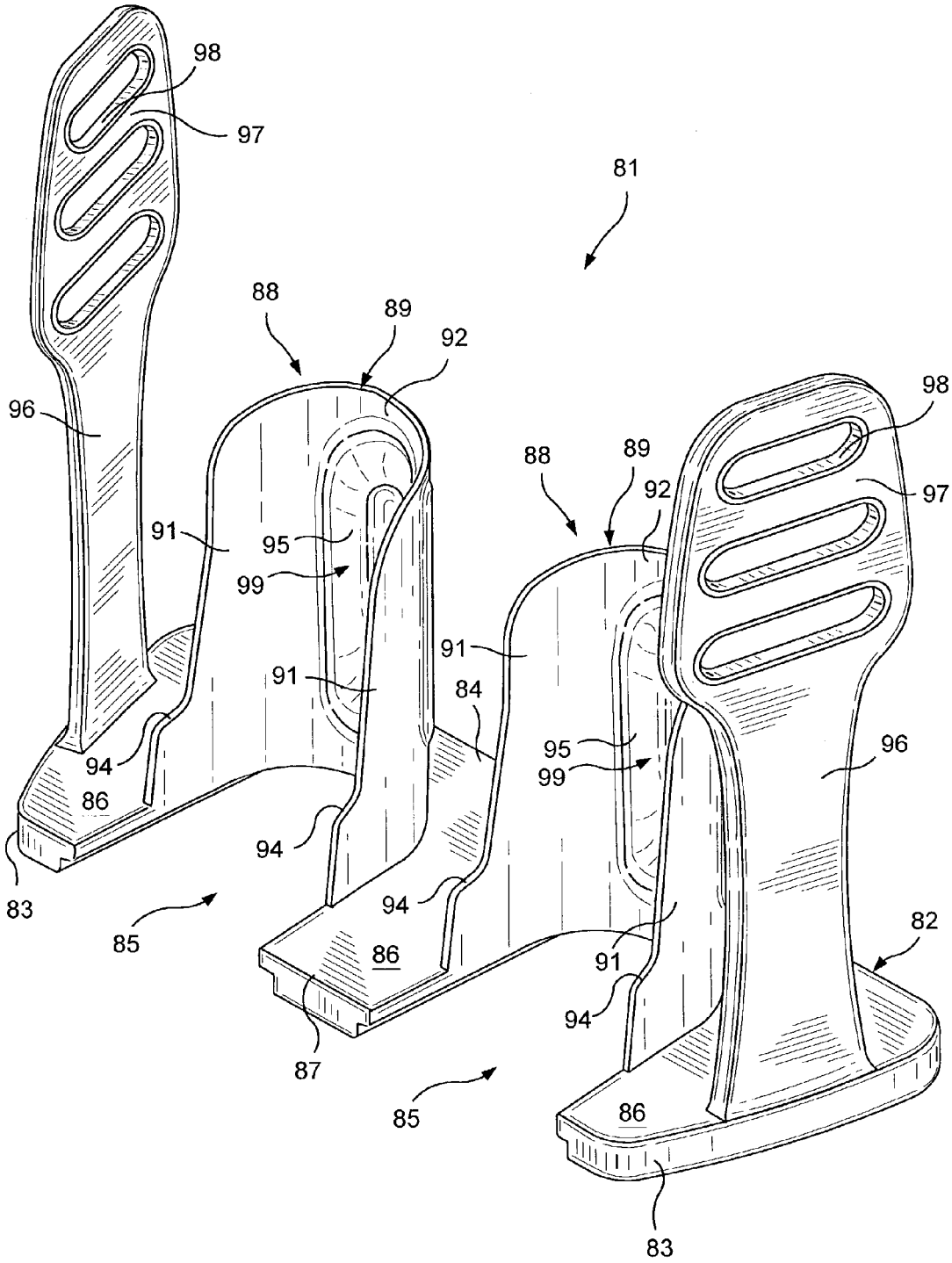
FIG. 19 is a front perspective view of a unitary construction embodiment of a dual-support hosiery donning aid of the present invention.

Referring next to FIG. 19, a unitary construction embodiment of a double-legged hosiery donning aid 81 is suitable for assisting in the donning of pantyhose or other double-legged hosiery (not shown). The hosiery donning aid 81 includes an elongated base 82, having a top surface 86 and a pair of spaced-apart side base portions 83 which are connected by a transverse rear base portion 84. A middle base portion 87 extends forwardly from the rear base portion 84. Generally U-shaped foot spaces 85 are defined in the base 82 on respective sides of the middle base portion 87, between the middle base portion 87 and each corresponding side base portion 83. Each of a pair of hosiery supports 88 includes a support element 89 extending outwardly from the top surface 86 of the base 82. Each support element 89 has a generally U-shaped configuration when viewed from above and includes a pair of side panel portions 91 which are continuous with a curved or arcuate rear portion 92. The side panel portions 91 generally extend outwardly and upwardly from the side base portions 83 and middle base portion 87, on opposite sides of the corresponding foot space 85, whereas the curved rear portion 92 extends outwardly and upwardly from the rear base portion 84, along the rear curvature of the corresponding foot space 85. An elongated, generally elliptical protrusion 95 preferably extends rearwardly from the transverse rear portion 92 of the support element 89 to define a heel-guiding and receiving depression 99. A gently sloping panel shoulder 94 is typically provided along a front edge of each side panel portion 91, proximate to the upper surface 86. A pair of slightly inwardly oriented handle supports 96 extend upwardly from the top surface 86 of the respective side base portions 83, on respective sides of and in spaced-apart relationship to the respective hosiery supports 88. The upper end of each handle support 96 includes a planar enlargement that defines a handle panel 97, through which typically extend one or more finger slots 98. The hosiery donning aid 81 is used in the manner heretofore described with respect to FIGS. 2A–2D, to assist a user in donning the double-legged hosiery such as pantyhose (not shown) on the user's legs.

Figure 20:
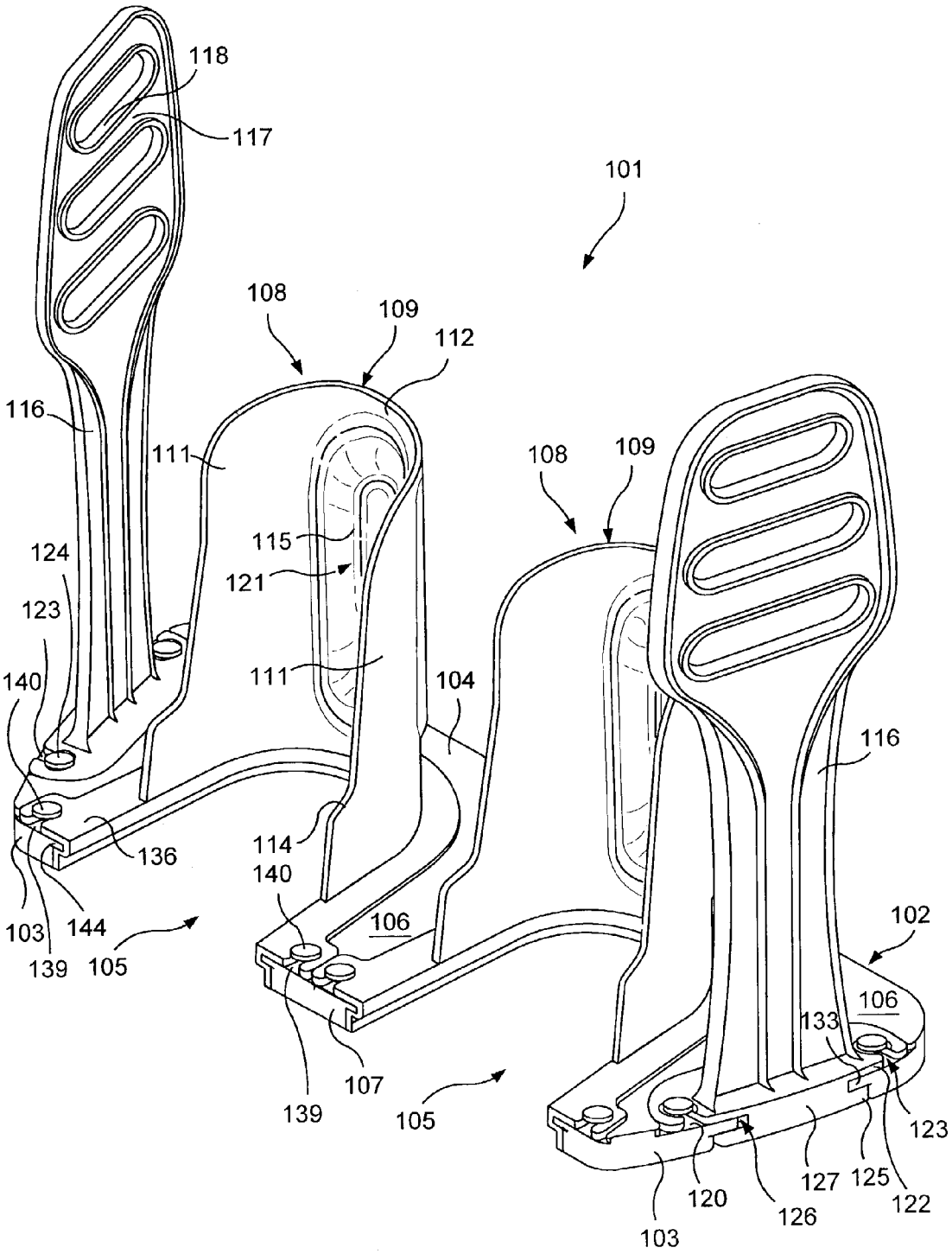
FIG. 20 is a front perspective view of an assembled multi-component construction embodiment of a dual-support hosiery donning aid of the present invention.

Referring next to FIG. 20, a multi-component embodiment of the double-legged hosiery donning aid 101 includes a generally E-shaped base 102, having a top surface 106 and a pair of spaced-apart side base portions 103 which are connected by a transverse rear base portion 104. A middle base portion 107 extends forwardly from the rear base portion 104, between the side base portions 103. A generally U-shaped foot space 105 is defined between the middle base portion 107 and each corresponding side base portion 103. A continuous, generally U-shaped base flange 144 extends substantially horizontally from the base 102 and into the corresponding foot space 105.

Each of a pair of hosiery supports 108 includes a support element 109 extending outwardly from a U-shaped substantially flat bottom flange 136. A transverse bottom flange 137, which is coextensive with the substantially flat bottom flange 136, extends downwardly therefrom. A fastener slot 139 terminates each end of the flat bottom flange 136. The U-shaped support element 109 includes a pair of side panel portions 111 which are continuous with a curved or arcuate rear portion 112. An elongated, generally elliptical panel protrusion 115 extends rearwardly from the curved rear panel portion 112 of each support element 109. A gently sloping panel shoulder 114 is typically provided along the a front edge of each side panel portion 111. Each hosiery support 108 is removably attached to the base 102 by causing engagement of the base flange 144 of the base 102 with the flat bottom flange 136 and transverse bottom flange 137 of the corresponding support panel 109. A fastener 140 is then extended downwardly through each respective slot 139 and threaded into a registering underlying screw opening (not shown) provided in the base 102, to secure the hosiery support 108 to the base 102.

The bottom end of each of a pair of handle supports 116 is provided with a handle support top flange 122 which is provided with a pair of spaced-apart screw openings 123. A handle support bottom flange 125 is connected to the handle support top flange 122 through a flange-connecting portion 127. A flange slot 126 is defined between the handle support top flange 122 and the handle support bottom flange 125. The upper end of each handle support 116 includes a planar enlargement that defines a handle panel 117, through which typically extend one or more finger slots 118. Stiffening ribs or flanges 119 may extend down the handle supports 116 for imparting bending and shearing resistance to the handle supports 116. Each handle support 116 is mounted on the base 102 by initially seating the handle support top flange 122 of each handle support 116 in a corresponding top flange depression 120 provided in the top surface 106 of each corresponding side base portion 103 as depression flanges 133 in the base 102 are inserted in the respective flange slots 126 of the handle support 116. Finally, a fastener or screw 124 can be extended through each fastener slot 123, so as to become associated with a corresponding underlying fastener opening (not shown) to secure the upward-standing handle supports 116 onto the base 102. When in the assembled configuration shown in FIG. 20, the multi-unit hosiery donning aid 101 may be used to don pantyhose or other double-legged hosiery (not shown) on the legs of a user, in the same manner as heretofore described with respect to the single-leg hosiery of FIGS. 2A–2D.

As disclosed hereinabove, the present invention provides a free standing hosiery donning aid that is sturdy, easy to use, and is capable of facilitating the smooth insertion of a user's foot and leg into the hosiery, while minimizing the likelihood of hosiery tearing. The hosiery donning aid of the invention is usable by handicapped persons and other individuals which lack often considerable hand and arm strength required to pull the hosiery up over the legs. This is accomplished by means of providing superior support to the hosiery and includes the guiding surfaces for the user's foot and leg, as the leg is being inserted into the stocking. The hosiery donning aid of the invention is capable of accommodating the hosiery of all types, including single and double-leg hosiery such as pantyhose.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A hosiery donning assembly, comprising:

a substantially solid base member formed with a generally U-shaped foot space;

at least one continuous hosiery support member having generally U-shaped configuration, said at least one continuous hosiery support member being unobstructed from one side thereof and configured to form a unitary structure with said substantially solid base member in such a maimer that said base member is disposed within a plane transverse to said support member, a lower end of said at least one continuous hosiery support member terminates at and at least partially coincides with said generally U-shaped foot space, and a substantially continuous surface is formed between said substantially solid base member and said at least one continuous hosiery support member.

2. A hosiery donning assembly as recited in claim 1, further comprising at least one handle support member having a hand gripping portion and substantially solid lower end portion, said at least one handle support member outwardly extending from and configured to form a substantially unitary structure with said base member.

3. A hosiery donning assembly as recited in claim 2, wherein said at least one handle support member further comprises a pair of handle support members each having the respective lower end portion configured for releasable attachment to said base member.

4. A hosiery donning assembly as recited in claim 3, wherein the hand gripping portion of each of said pair of handle support members further comprise a handle panel having at least one finger receiving slot extending therethough.

5. A hosiery donning assembly as recited in claim 1, wherein said base member further comprises a unitary member having a transverse rear base portion adjoining a pair of forwardly extending side base portions, said rear and side base portions defining said generally U-shaped foot space.

6. A hosiery donning assembly as recited in claim 1, wherein said at least one hosiery support member further comprises a generally U-shaped support panel defined by a front portion and a pair of side panel portions contiguous with an arcuate rear portion, at least partially coinciding with a perimeter of the generally U-shaped foot space of said base member and configured for attachable engagement therewith said front portion being unobstructed through entire length of the hosiery support member.

7. A hosiery donning assembly as recited in claim 6, wherein, said arcuate rear portion has an elongated panel protrusion formed therein and defining an interior depression configured for slidably engaging and guiding a heel portion of a human foot.

8. A hosiery donning assembly as recited in claim 6, further comprising a panel shoulder shaped in said support panel portion.

9. A hosiery donning assembly as recited in claim 1, wherein said at least one hosiery support member further comprises a pair of hosiery support members each configured for releasable attachment to said base member.

10. A hosiery donning assembly as recited in claim 9, wherein said base member further comprises a unitary member having a transverse rear base portion adjoining a pair of forwardly extending side base portions and a forwardly extending central base portion, said side and central base portions defining a pair of spaced apart generally U-shaped foot spaces.

11. A hosiery donning assembly as recited in claim 10, wherein the support element of each of said hosiery support member further comprises a generally U-shaped support panel defined by a pair of side panel portions contiguous with an arcuate rear portion, a lower end of each said hosiery support member at least partially coinciding with the perimeter of a corresponding one of said generally U-shaped base member foot space and configured for releasable engagement therewith.

12. A hosiery donning assembly as recited in claim 11, wherein each of said arcuate rear portions has an elongated panel protrusion formed therein and defining an interior depression configured for slidably engaging and guiding a heel portion of a human foot.

13. A hosiery donning assembly as recited in claim 11, further comprising a panel shoulder shaped in each of said support panel portions.

14. A hosiery donning aid, comprising a base;

at least one hosiery support having a support element carried by said base, said base being disposed within a plane transverse to said at least one hosiery support, said support element having a generally U-shaped hosiery support panel defined by a pair of side panel portions contiguous with an arcuate rear portion, said arcuate rear portion having an elongated protrusion formed therein and defining a depression configured for slidably engaging and guiding a heel potion of a human foot.

15. A hosiery donning aid as recited in claim 14, further comprising at least one handle support having a handle outwardly extending from said base in adjacent relationship to said at least one hosiery support.

16. A hosiery donning aid as recited in claim 15, wherein said at least one handle support further comprises a pair of handle supports extending outwardly from said base on respective sides of said at least one hosiery support.

17. A hosiery donning aid as recited in claim 16, wherein each said handle support is positioned at an angle to a longitudinal axis of said base.

18. A hosiery donning aid as recited in claim 15, wherein the handle of said at least one handle support further comprises a handle panel having at least one finger-receiving slot extending therethough.

19. A hosiery donning aid as recited in claim 15, wherein said at least one hosiery support and said at least one handle support are fixedly attached to said base.

20. A hosiery donning aid as recited in claim 14, wherein said base further comprises a transverse rear base portion adjoining a pair of forwardly extending side base portions, said rear and side base portions substantially defining a generally U-shaped foot space.

21. A hosiery donning aid as recited in claim 20, wherein a lower end of said generally U-shaped unitary support panel at least partially coincides with a perimeter of said generally U-shaped foot space.

22. A hosiery donning aid as recited in claim 20, further comprising a panel shoulder shaped in said support panel.

23. A hosiery donning aid as recited in claim 14, wherein said at least one hosiery support further comprises a pair of adjacent hosiery supports each having a support panel carried by said base.

24. A hosiery donning aid as recited in claim 14, wherein said elongated protrusion extends along a longitudinal axis of said hosiery support.

25. A hosiery donning aid as recited in claim 14, wherein said elongated protrusion is formed by curved sections provided at both ends thereof and a substantially linier section interposed therebetween.

* * * * *